US008710743B2

(12) United States Patent
Winzek

(10) Patent No.: US 8,710,743 B2
(45) Date of Patent: Apr. 29, 2014

(54) DISCHARGE LAMP COMPRISING COATED ELECTRODE

(75) Inventor: Bernhard Winzek, Berlin (DE)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 13/320,539

(22) PCT Filed: Apr. 22, 2010

(86) PCT No.: PCT/EP2010/055313

§ 371 (c)(1),
(2), (4) Date: Nov. 14, 2011

(87) PCT Pub. No.: WO2010/130542

PCT Pub. Date: Nov. 18, 2010

(65) Prior Publication Data

US 2012/0062101 A1 Mar. 15, 2012

(30) Foreign Application Priority Data

May 14, 2009 (DE) ..... 10 2009 021 235

(51) Int. Cl.
*H01J 17/04* (2012.01)
*H01J 61/073* (2006.01)

(52) U.S. Cl.
USPC ..... 313/633; 313/631; 313/632; 313/311; 313/630

(58) Field of Classification Search
USPC ..... 313/633, 634
See application file for complete search history.

(56) References Cited

U.S. PATENT DOCUMENTS

| | | | | |
|---|---|---|---|---|
| 3,248,591 | A | 4/1966 | Arndt | |
| 4,303,848 | A * | 12/1981 | Shimizu et al. | 313/346 R |
| 5,530,317 | A * | 6/1996 | Willemsen et al. | 313/633 |
| 5,929,565 | A * | 7/1999 | Mayama et al. | 313/631 |
| 6,844,678 | B2 * | 1/2005 | Okanuma et al. | 313/633 |
| 7,569,994 | B2 * | 8/2009 | Ikeuchi | 313/633 |
| 2002/0079842 | A1 * | 6/2002 | Ehrlichmann et al. | 313/639 |

FOREIGN PATENT DOCUMENTS

| | | | |
|---|---|---|---|
| DE | 29 51 741 | | 7/1980 |
| DE | 101 32 797 | | 5/2002 |
| EP | 0 791 950 | | 8/1997 |
| JP | 55074051 | A * | 6/1980 |
| JP | 02-256150 | | 10/1990 |
| JP | 09-115479 | | 5/1997 |
| JP | 2001-189145 | | 7/2001 |
| JP | 2001-513255 | | 8/2001 |
| JP | 2004-259639 | | 9/2004 |
| JP | 2008-186790 | | 8/2008 |

* cited by examiner

*Primary Examiner* — Sikha Roy
(74) *Attorney, Agent, or Firm* — Cozen O'Connor

(57) ABSTRACT

A discharge lamp (1) comprising a discharge vessel (4), at least one electrode (22, 24) arranged within the discharge vessel, wherein at least parts of the electrode (22) are provided with a particle composite coating (32) made up of a matrix layer and particles embedded in the matrix layer, wherein the extinction coefficient k of the material for the matrix layer is less than 0.1 in the spectral range between 600 nm and 2 μm, and wherein the extinction coefficient k of the material for the particles is greater than 0.1 in the spectral range between 600 nm and 2 μm.

10 Claims, 1 Drawing Sheet

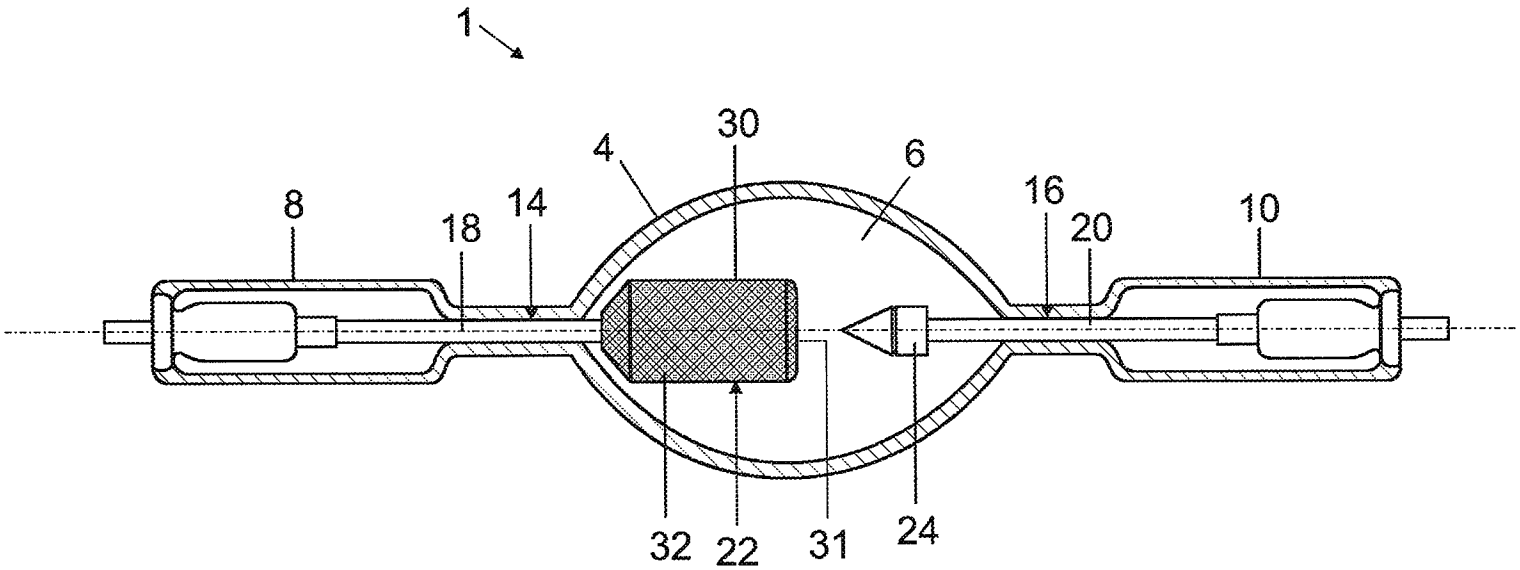
1
8
18
14
4
30
6
16
20
10
32
22
31
24

DISCHARGE LAMP COMPRISING COATED ELECTRODE

RELATED APPLICATIONS

This is a U.S. national stage of application No. PTC/EP2010/055313, filed on Apr. 22, 2010.

This application claims the priority of German Application No. 10 2009 021 235.3 filed May 14, 2009, the entire content of which is hereby incorporated by reference.

FIELD OF THE INVENTION

The starting point for the invention is a discharge lamp, in particular a short-arc discharge lamp, with a discharge vessel and electrodes arranged within it.

BACKGROUND OF THE INVENTION

When discharge lamps are operated, a plasma discharge arc is produced between the electrodes and this emits electromagnetic radiation. The electrodes consist mostly of tungsten, because tungsten is a tough material which only melts at very high temperatures. In particular in the case of short-arc lamps, in which the electrodes are subject to great stresses, high electrode temperatures arise. As a consequence, evaporation of electrode material occurs at the tips of the electrodes, and this deposits on the inner side of the lamp bulb, resulting in blackening of the bulb. This blackening inevitably has the effect of an unwanted reduction in the strength of the radiation during the burning time.

Especially in the case of lithographic patterning of semiconductors, a reduction in the radiation strength results in a lengthening of production times due to the longer exposure times, and in extreme cases can necessitate a premature lamp replacement.

The vapor pressure of any material increases exponentially with rising temperature, so that it is possible by reducing the electrode tip temperatures to efficiently reduce the vapor pressure, and as a consequence the material erosion at the electrode tips and, thereby ultimately also reduce the blackening of the bulb. Such a reduction in temperature can be achieved by an emission-raising coating on the electrode.

From WO 00/08672, an electrode for a high-pressure discharge lamp is known which uses a dendritic layer of rhenium or other high melting-point metals. The term dendritic layer is to be understood as a nanostructure which is formed by numerous needle-shaped growths on the otherwise smooth surface. The surface of such a dendritic layer appears dark grey to black, and achieves an emission coefficient of over 0.8. The operating temperatures on an anode plateau can thereby be reduced by up to 500 K compared to uncoated anodes. A disadvantage of dendritic layers of this type is the high expense of manufacture and the associated high costs. The application of dendritic coatings by means of CVD or PVD techniques is very costly. Furthermore, burning time tests on lamps subject to great stresses with such anode coatings have shown that even the dendritic needle structures lose their initial form over the course of the service life, and thus the anode loses its original good emissivity.

SUMMARY OF THE INVENTION

One object of the present invention is to provide a discharge lamp with an improved electrode so as to extend the service life of the lamp. A further object is the reduction in the degradation of the usable radiation emitted by the lamp, i.e. depending on the type of lamp either ultra-violet (UV) radiation or visible light.

This object is achieved in accordance with one aspect of the invention directed to a discharge lamp comprising a discharge vessel, at least one electrode arranged within the discharge vessel, the electrode being provided at least partially with a particle composite coating made up of a matrix layer and particles embedded in the matrix layer, and the extinction coefficient k of the material for the matrix layer being less than 0.1 in the spectral range between 600 nm and 2 μm, and the extinction coefficient k of the material for the particles being greater than 0.1 in the spectral range between 600 nm and 2 μm.

In accordance with the current state of knowledge, the assumption is made that the islands of particles are distributed in the matrix layer, which is largely transparent in the infrared spectral range, and thus represent a "rough" surface. The ultimate result of this is—as per the object—a higher emission coefficient.

The particles do not need to have any particular size distribution. The mean particle size will preferably be less than the thickness of the matrix layer. In addition, the particles will consist of a material which is not transparent in the visible or infra-red spectral range. More precisely stated, the extinction coefficient k of the material for the particles should be greater than 0.1 in the spectral range between 600 nm and 2 μm. In addition, the melting point of the particles should be as high as possible, preferably greater than 2000° C., in particular preferably greater than 2500° C. The particles will in particular be metal, preferably tungsten.

The matrix layer consists of a material which is transparent in the visible and infrared spectral range. More precisely stated, the extinction coefficient k of the material for this matrix layer should preferably be less than 0.1 in the spectral range between 600 nm and 2 μm, especially preferably less than 0.01 in the spectral range between 400 nm and 8 μm. In addition, the melting point of the matrix material should be as high as possible, preferably greater than 2000° C., in particular preferably greater than 2500° C. Suitable material classes include oxides, fluorides, carbides and nitrides, for example $ZrO_2$, $MgF_2$, SiC or AlN respectively. $ZrO_2$ has proved to be particularly suitable for an oxidic matrix layer, because it combines a high mechanical stability with high transparency. For an adequate layer thickness and at sufficiently high temperatures, $ZrO_2$ has an emission factor of 0.85. In the case of a $ZrO_2$ layer of this type, the emission factor is thus significantly higher than the maximum of 0.6 which has been measured at the surface of anodes with tungsten powder sintered onto them. As the layer thickness reduces, so too the emission factor drops, because the $ZrO_2$ layer becomes increasingly transparent for the infra-red radiation, and thus the surface properties of the underlying substrate dominate. The embedded metal particles then work as a porous metal layer, for which the emission factor at temperatures between about 1000 and 2500° C. ranges up to 1.0. The matrix affords stability to this metal structure. This can be further increased by adding $Y_2O_3$ and/or MgO. Alternatively, the matrix layer can even consist solely of $Y_2O_3$ or MgO, as appropriate, instead of $ZrO_2$.

The thickness of the matrix layer will preferably lie in the range between 1 micrometer and 1 millimeter, especially preferably between 10 μm and 300 μm. The grain size of the metal particles will preferably lie in the range between 20 nm and the thickness of the matrix layer. The proportion by volume of the metal particles can appropriately be in the range between 2 and 50%, preferably between 5 and 30%, especially preferably between 5 and 15%.

The layer in accordance with an embodiment of the invention can be manufactured cheaply by sintering it on. To do so, the individual components can be mixed together before they are applied onto the body of the electrode, or applied one after another.

Commercial binders for sintering metal and ceramic powders can be used for the sintering on. The powder is stirred together with the binder and applied. After this, the electrode is raised to incandescence to drive off the binder and sinter the powder. The incandescence temperature can here exceed the sintering temperature, so that the material of the layer matrix can fuse on.

It is preferable if the region of the electrode which is directly struck by the radiation emitted from the plasma arc during operation of the lamp is not coated with the matrix layer, because the coating can in some circumstances be damaged in the plasma region.

BRIEF DESCRIPTION OF THE SINGLE DRAWING

In what follows, the invention will be explained in more detail by reference to an exemplary embodiment. The single FIGURE shows a short-arc discharge lamp with coated anode.

PREFERRED EMBODIMENT OF THE INVENTION

The invention is explained below by reference to a xenon short-arc lamp (OSRAM XBO®). In the case of a xenon short-arc lamp, a discharge arc burns in an atmosphere of pure xenon gas (or gas mixture) under high pressure. XBO lamps are used, for example in classical and digital film projection.

The FIGURE shows a schematic diagram of a high-pressure discharge lamp 1 using short-arc technology which has sockets on two sides and is designed for DC operation. This has a discharge vessel 4 made of quartz glass, with a discharge space 6 and arranged diametrally in the discharge vessel 4 two sealed bulb shafts 8, 10, the free end sections of which can each be provided with a socket fitting, which is not shown. Into the discharge space 6 project two electrode systems 14, 16 which run within the bulb shafts 8, 10 and between which a gas discharge (arc) arises during operation of the lamp. Enclosed within the discharge space 6 of the discharge vessel 4 is a xenon gas filling, typically having a cold pressure of 1 bar.

In the case of the exemplary embodiment illustrated, the electrode system 14, 16 at each of the two sides is constructed with a current-supplying rod-shaped electrode holder 18, 20 and soldered onto these on the discharge side an anode 22 or cathode 24 respectively. As shown in FIG. 1, the cathode 24 arranged on the right is designed as a cone-shape for the purpose of producing high temperatures, to ensure a defined starting point for the arc and an adequate flow of electrons due to thermal emission and field emission (Richardson equation).

The anode 22, which is subject to high thermal stresses, is designed with a cylindrical shape. For the purpose of improving the thermal emission power its surface 30 is, except for the front face 31 which faces the cathode opposite it or in operation faces the plasma arc, as applicable, provided with a particle composite coating 32 made of a $ZrO_2$ matrix layer with embedded tungsten particles. To effect this, a powder mixture of 10% by volume of tungsten and 90% by volume of $ZrO_2$ is sintered on. At the operating temperature of the anode 22, which averaged over the whole anode is typically 1500° C., this particle composite coating 32 has an emission coefficient $\epsilon$ of approx. 0.95, and has thereby an exceptionally high emission of radiation by comparison, for example, with the untreated anode, for which the value of the emission coefficient $\epsilon$ is 0.25. This results in a lower thermal stress on the discharge lamp 1.

Measurements of the effect of the tungsten content of a particle composite with a $ZrO_2$ matrix on the emission coefficient $\epsilon$ have shown that there is a maximum at around 10% by volume of tungsten, where the value of $\epsilon$ is almost 1 at temperatures between 1000° C. and 2500° C.

The invention has been explained above by the example of a xenon short-arc lamp. However, the advantageous effects of the invention can equally well be achieved for mercury vapor short-arc lamps (OSRAM HBO®). In the case of a mercury vapor short-arc lamp, the discharge medium is mercury vapor and one or more noble gases. HBO lamps are used in the electrical/electronic industry, for example in microchip and LCD manufacture.

The invention has been described above by the example of a DC-powered discharge lamp. Nevertheless, the invention is not restricted to DC discharge lamps. Rather, the advantageous effect also manifests itself with AC discharge lamps.

Thus, while there have been shown and described and pointed out fundamental novel features of the invention as applied to a preferred embodiment thereof, it will be understood that various omissions and substitutions and changes in the form and details of the device illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested from or embodiment as a general matter of design choice. It is the intention, therefore, to be limited only as indicated by the scope of the claims appended hereto.

The invention claimed is:

1. A discharge lamp comprising:

a discharge vessel; and at least an anode arranged within the discharge vessel, wherein at least parts of the anode are provided with a particle composite coating comprising a matrix layer and tungsten particles embedded in the matrix layer, wherein the proportion by volume of the tungsten particles lies in the range between 2 and 50%, wherein the extinction coefficient k of the material for the matrix layer is less than 0.1 in the spectral range between 600 nm and 2 μm, wherein the extinction coefficient k of the material for the particles is greater than 0.1 in the spectral range between 600 nm and 2 μm, and wherein the discharge lamp is a short-arc discharge lamp configured for direct current (DC) operation.

2. The discharge lamp as claimed in claim 1, wherein the extinction coefficient k of the material for the matrix layer is less than 0.01 in the spectral range between 400 nm and 8 μm.

3. The discharge lamp as claimed in claim 1, wherein the matrix layer consists of one or more elements from the following group: oxides, carbides, nitrides, fluorides.

4. The discharge lamp as claimed in claim 3, wherein the matrix layer consists of one or more elements from the following group: $ZrO_2$, $MgF_2$, SiC, AlN.

5. The discharge lamp as claimed in claim 4, wherein $Y_2O_3$ and/or MgO is added to the matrix layer.

6. The discharge lamp as claimed in claim 1, wherein the thickness of the matrix layer lies in the range between 1 micrometer and 1 millimeter.

7. The discharge lamp as claimed in claim 1, wherein the grain size of the particles lies in the range between 20 nm and the thickness of the matrix layer.

8. The discharge lamp as claimed in claim 1, wherein a region of the anode which is directly struck by radiation emitted in a plasma arc when the lamp is in operation is not coated.

9. The discharge lamp as claimed in claim 1, wherein the proportion by volume of the tungsten particles lies in the range between 5 and 30%.

10. The discharge lamp as claimed in claim 1, wherein the proportion by volume of the tungsten particles lies in the range between 5 and 15%.

* * * * *